US010543138B2

(12) United States Patent
Shih

(10) Patent No.: US 10,543,138 B2
(45) Date of Patent: Jan. 28, 2020

(54) INFLATABLE AIR MATTRESS DEVICE

(71) Applicant: CAREMED SUPPLY INC., New Taipei (TW)

(72) Inventor: Boris Shih, Taipei (TW)

(73) Assignee: CAREMED SUPPLY INC., New Taipei (TW)

( * ) Notice: Subject to any disclaimer, the term of this patent is extended or adjusted under 35 U.S.C. 154(b) by 264 days.

(21) Appl. No.: 15/594,108

(22) Filed: May 12, 2017

(65) Prior Publication Data

US 2018/0325761 A1 Nov. 15, 2018

(51) Int. Cl.

| | |
|---|---|
| ***A61G 7/057*** | (2006.01) |
| ***A47C 27/08*** | (2006.01) |
| ***A47C 27/10*** | (2006.01) |

(52) U.S. Cl.

CPC ..... *A61G 7/05784* (2016.11); *A47C 27/082* (2013.01); *A47C 27/088* (2013.01); *A47C 27/10* (2013.01); *A61G 7/05769* (2013.01)

(58) Field of Classification Search

CPC ..... A47C 27/10; A47C 27/08; A47C 27/081; A47C 27/082; A47C 27/083; A47C 27/088; A47C 27/18; A61G 7/05769; A61G 7/05776

USPC ..... 5/713, 710, 709, 706, 655.3, 654

See application file for complete search history.

(56) References Cited

U.S. PATENT DOCUMENTS

| | | | | | |
|---|---|---|---|---|---|
| 3,653,083 | A * | 4/1972 | Lapidus | A47C 27/081 | 5/709 |
| 4,995,124 | A * | 2/1991 | Wridge, Jr. | A47C 27/083 | 5/709 |
| 5,142,717 | A * | 9/1992 | Everard | A47C 27/083 | 5/709 |
| 5,249,319 | A * | 10/1993 | Higgs | A47C 27/082 | 5/713 |
| 5,325,551 | A * | 7/1994 | Tappel | A47C 27/082 | 5/709 |
| 5,542,136 | A * | 8/1996 | Tappel | A61G 7/05776 | 5/658 |
| 5,564,142 | A * | 10/1996 | Liu | A61G 7/05776 | 5/689 |
| 5,794,289 | A * | 8/1998 | Wortman | A61G 7/001 | 5/423 |
| 5,966,762 | A * | 10/1999 | Wu | A61G 7/05769 | 5/615 |

(Continued)

*Primary Examiner* — Robert G Santos

(74) *Attorney, Agent, or Firm* — Rabin & Berdo, P.C.

(57) ABSTRACT

An inflatable air mattress device includes a cover internally defining a first and a second receiving zone for receiving a pump and an air mattress therein, respectively. The air mattress includes a plurality of parallelly arranged air cells, each of which internally includes a first air chamber located below a second air chamber and having an elastic member provided therein. The pump is held in the first receiving zone via a movement-limiting mechanism and is provided with an air input and an air release line for communicably connecting to each of the air cells. Since the air cells, the pump and the air input and release lines all are arranged inside the cover, the inflatable air mattress device has an esthetic appearance and occupies less space. The elastic members in the first air chambers prevent a user from contacting with a hard bed frame when the air cells are deflated.

10 Claims, 15 Drawing Sheets

(56) References Cited

U.S. PATENT DOCUMENTS 6,014,784 A * 1/2000 Taylor ..... A61G 7/05776 297/284.6
6,061,855 A * 5/2000 Flick ..... A61G 7/001 5/655.3
6,148,461 A * 11/2000 Cook ..... A61G 7/05769 5/706
6,591,437 B1 * 7/2003 Phillips ..... A61G 7/05769 5/706
6,691,355 B1 * 2/2004 Liu ..... A61G 7/05715 5/655.5
7,086,104 B1 * 8/2006 Tsay ..... A61G 7/05776 5/655.3
7,107,640 B2 * 9/2006 Chapman ..... A61G 7/05776 5/710
8,006,333 B2 * 8/2011 Genaro ..... A61G 7/05776 5/615
8,201,292 B2 * 6/2012 Dionne ..... A61G 7/001 5/706
9,095,224 B2 * 8/2015 Tanaka ..... A47C 27/082
9,114,048 B2 * 8/2015 Takeda ..... A61G 7/05776
9,326,904 B2 * 5/2016 Nomura ..... A61G 7/05776
9,597,244 B2 * 3/2017 Ishibashi ..... A47C 27/083
9,622,589 B2 * 4/2017 Nomura ..... A61G 7/05776
9,867,748 B2 * 1/2018 Takeda ..... A61G 7/05776
10,070,733 B2 * 9/2018 Ohno ..... A47C 27/10
10,334,959 B2 * 7/2019 Ohno ..... A61G 7/057
2002/0133882 A1 * 9/2002 Chapman ..... A61G 7/05776 5/713
2006/0168735 A1 * 8/2006 Tsay ..... A61G 7/05776 5/655.3
2008/0120780 A1 * 5/2008 Genaro ..... A61G 7/05776 5/600
2008/0141463 A1 * 6/2008 Dionne ..... A61G 7/001 5/713
2012/0291204 A1 * 11/2012 Takeda ..... A61G 7/05776 5/710
2012/0304385 A1 * 12/2012 Ishibashi ..... A47C 27/083 5/613
2012/0311790 A1 * 12/2012 Nomura ..... A61G 7/05776 5/710
2012/0317727 A1 * 12/2012 Tanaka ..... A47C 27/082 5/710
2016/0008198 A1 * 1/2016 Takeda ..... A61G 7/05776 5/710
2016/0157627 A1 * 6/2016 Nomura ..... A61G 7/05776 5/710
2017/0202364 A1 * 7/2017 Ohno ..... A47C 27/10
2018/0325761 A1 * 11/2018 Shih ..... A61G 7/05715
2018/0344048 A1 * 12/2018 Ohno ..... A47C 27/10
2019/0290016 A1 * 9/2019 Miller, Jr. ..... A47C 27/082

* cited by examiner

INFLATABLE AIR MATTRESS DEVICE

FIELD OF THE INVENTION

The present invention relates to an inflatable air mattress for supporting a patient thereon, and more particularly, to an inflatable air mattress device that has a pump installed inside a cover of the device.

BACKGROUND OF THE INVENTION

A patient who can not move freely or is confined to bed due to some reason tends to suffer from bedsore and tissue necrosis as a result of poor blood circulation and localized damage to the skin under pressure over a long time. To avoid the bedridden patient from forming bedsore, an alternating pressure air mattress has been developed and introduced into the market.

A conventional alternating pressure air mattress includes a plurality of air cells that can be inflated and deflated, and a pump that is used to inflate and deflate the air cells alternately. With the alternately inflated and deflated air cells, the bedridden patient's body areas frequently contacting with the bed are not constantly subjected to pressure and the possibility of forming bedsore on the patient's skin is effectively reduced.

FIG. 1 shows a conventional alternating pressure air mattress structure, which mainly includes an air mattress 10 and an inflating device 11 located outside the air mattress 10. The air mattress 10 includes a plurality of transverse supporting air cells 101 parallelly arranged side by side; and the inflating device 11 includes an air delivery controller 111 and a plurality of air delivery lines 112 connected to between the supporting air cells 101 and the air delivery controller 111.

The above-described conventional alternating pressure air mattress structure has some disadvantages. First, the air delivery controller 111 is located outside the air mattress 10, and a large part of the air delivery lines 112 is exposed from the air mattress 10. The exposed air delivery lines 112 not only cause difficulty in organizing the lines, but also tend to trip someone nearby. Second, in the case the supporting air cells 101 of the conventional air mattress structure are deflated or leaked, the patient lying thereon is no longer supported by the supporting air cells and in direct contact with the hard bed frame, which will cause discomfort to the patient and even cause bedsore in some worse condition.

In view of the disadvantages of the conventional air mattress structure, it is tried by the inventor to develop an improved inflatable air mattress device, so that the air delivery controller and the air mattress together form an integral air mattress structure.

SUMMARY OF THE INVENTION

A primary object of the present invention is to provide an inflatable air mattress device that includes a plurality of volume changeable air cells and a pump; and the air cells, the pump and air input and release lines of the pump all are arranged inside a cover of the inflatable air mattress device, allowing the whole inflatable air mattress device to have an esthetic appearance and occupy less space.

Another object of the present invention is to provide an inflatable air mattress device that includes a plurality of air cells, in each of which an elastic member is provided to prevent a user from contacting with a hard bed frame when the air cells are deflated.

To achieve the above and other objects, the inflatable air mattress device provided according to the present invention includes a cover, an air mattress and a pump. The cover includes a top portion, a bottom portion and a wall portion connected to between the top and the bottom portion. The top portion, the bottom portion and the wall portion together define a receiving space in between them. A part of the receiving space forms a first receiving zone while the rest part of the receiving space forms a second receiving zone. The first receiving zone adjoins at least one wall surface of the wall portion and has a movement-limiting mechanism installed therein.

The movement-limiting mechanism includes a seat portion and a cap portion pivotally movable relative to the seat portion to change a relative position between the cap portion and the seat portion. The seat portion and the cap portion together define a movement-limiting space in between them for holding the pump therein. A line-connecting passage having a size smaller than a sectional height of the pump is formed between the cap portion and the seat portion when the cap portion is moved to a position immediately above the seat portion; and a pump-removal passage having a size larger than the sectional height of the pump is formed between the cap portion and the seat portion when the cap portion is moved to a position away from the seat portion.

The cap portion of the movement-limiting mechanism includes a first receiving section internally defining a first space and a stop section extended around a lower peripheral edge of the first receiving section; and the seat portion of the movement-limiting mechanism includes a second receiving section internally defining a second space. The first space and the second space respectively have a piece of elastic material received therein. The first receiving section of the cap portion is externally provided with a male connecting element and the wall portion of the cover is internally provided with a female connecting element at a location corresponding to the male connecting element.

The top portion of the cover and an outer part of the wall portion of the cover together define an upper cover, and the bottom portion of the cover and an inner part of the wall portion of the cover together define a lower cover; and the upper cover is movable relative to the lower cover. The inner part of the wall portion is provided at a section adjacent to the pump with a plurality of heat-dissipation holes; and the outer part of the wall portion has a vertical height smaller than that of the inner part of the wall portion, so that the heat-dissipation holes are not blocked by the outer part of the wall portion.

The air mattress is installed in the second receiving zone of the receiving space in the cover and consists of a plurality of transverse air cells parallelly arranged side by side. Each of the air cells includes a first air chamber and a second air chamber located immediately above the first air chamber; and the first air chamber is internally provided with an elastic member.

In a preferred embodiment of the present invention, a part of the air cells has a first width while the rest part of the air cells has a second width; and a sum of the second width of the air cells and a width of the pump is equal to the first width of the air cells. All the air cells are connected to an air release line, and the air release line has an air release valve mounted thereon for controlling the air release line to an open state or a closed state.

The pump is installed in the first receiving zone of the receiving space and held in the movement-limiting mechanism. The pump is provided with an air input line communicably connected to each of the air cells of the air mattress for supplying air into the air cells to change a volume of each of the air cells.

The inflatable air mattress device further includes a locating device. The locating device is set in the second receiving zone of the receiving space and includes a bottom board and a plurality of locating elements sequentially connected in pairs to two opposite longitudinal sides of the bottom board. Each of the locating elements internally defines a fitting passage for receiving an end of one air cell therein, such that the air cells are held to the bottom board side by side with respective two ends extended through a pair of two laterally aligned fitting passages defined by two corresponding locating elements on the bottom board.

The inflatable air mattress device of the present invention is characterized in that the pump, which was usually located outside the air mattress, is now installed inside the cover of the inflatable air mattress device. That is, the air cells of the air mattress and the pump and the air input and release lines thereof all are arranged inside the cover of the inflatable air mattress device, allowing the whole inflatable air mattress device to have an esthetic appearance and occupy less space. Further, the inflatable air mattress device of the present invention is also characterized in that each of the air cells of the air mattress has an elastic member provided in a lower air chamber thereof, so that a user lying on the inflatable air mattress device still feels comfortable even when the air cells are deflated.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
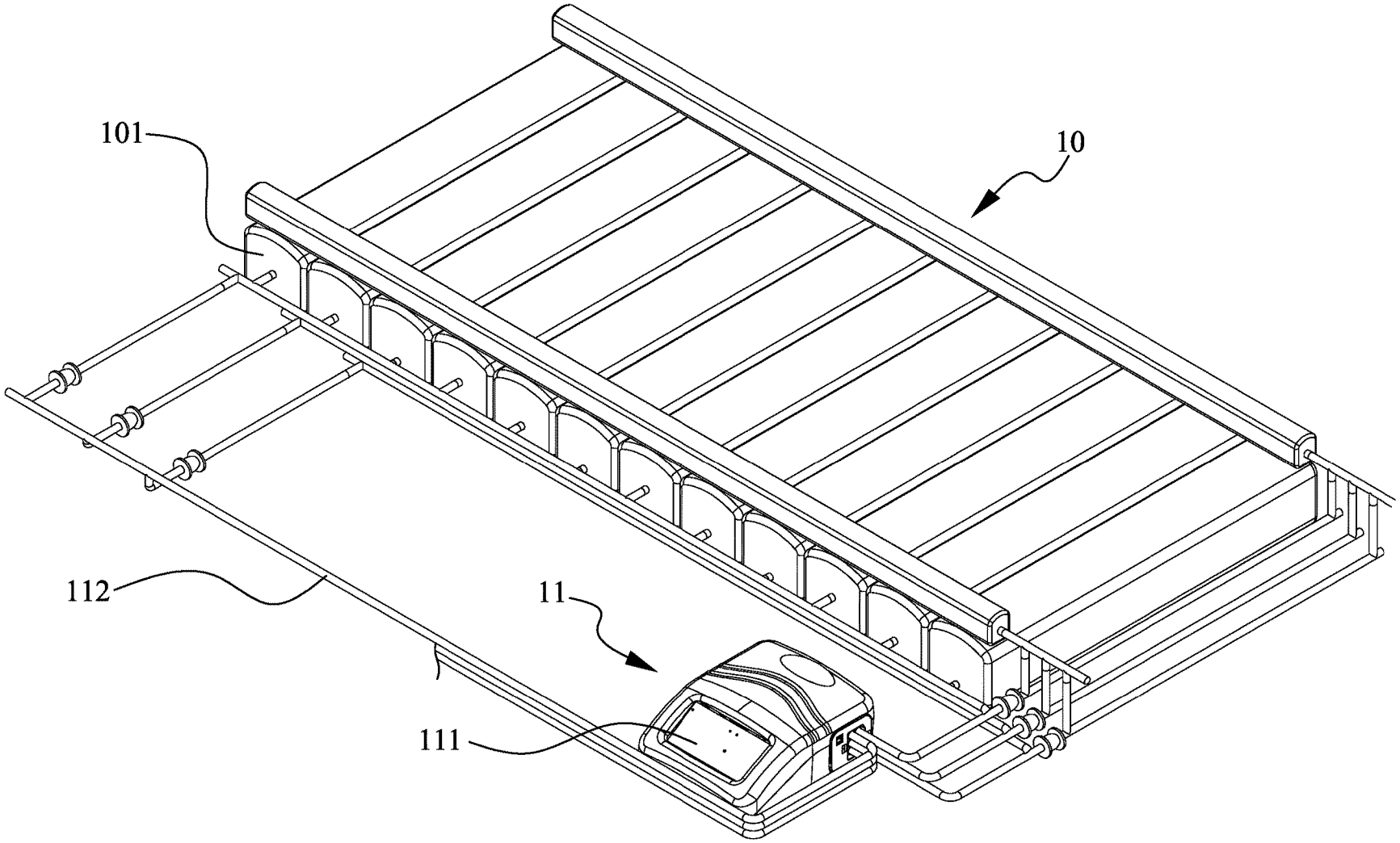
FIG. 1 (Prior Art)
FIG. 1 is a perspective view of a conventional alternating pressure air mattress structure.

The present invention will now be described with some preferred embodiments thereof and by referring to the accompanying drawings. For the purpose of easy to understand, elements that are the same in the preferred embodiments are denoted by the same reference numerals.

Figure 2:
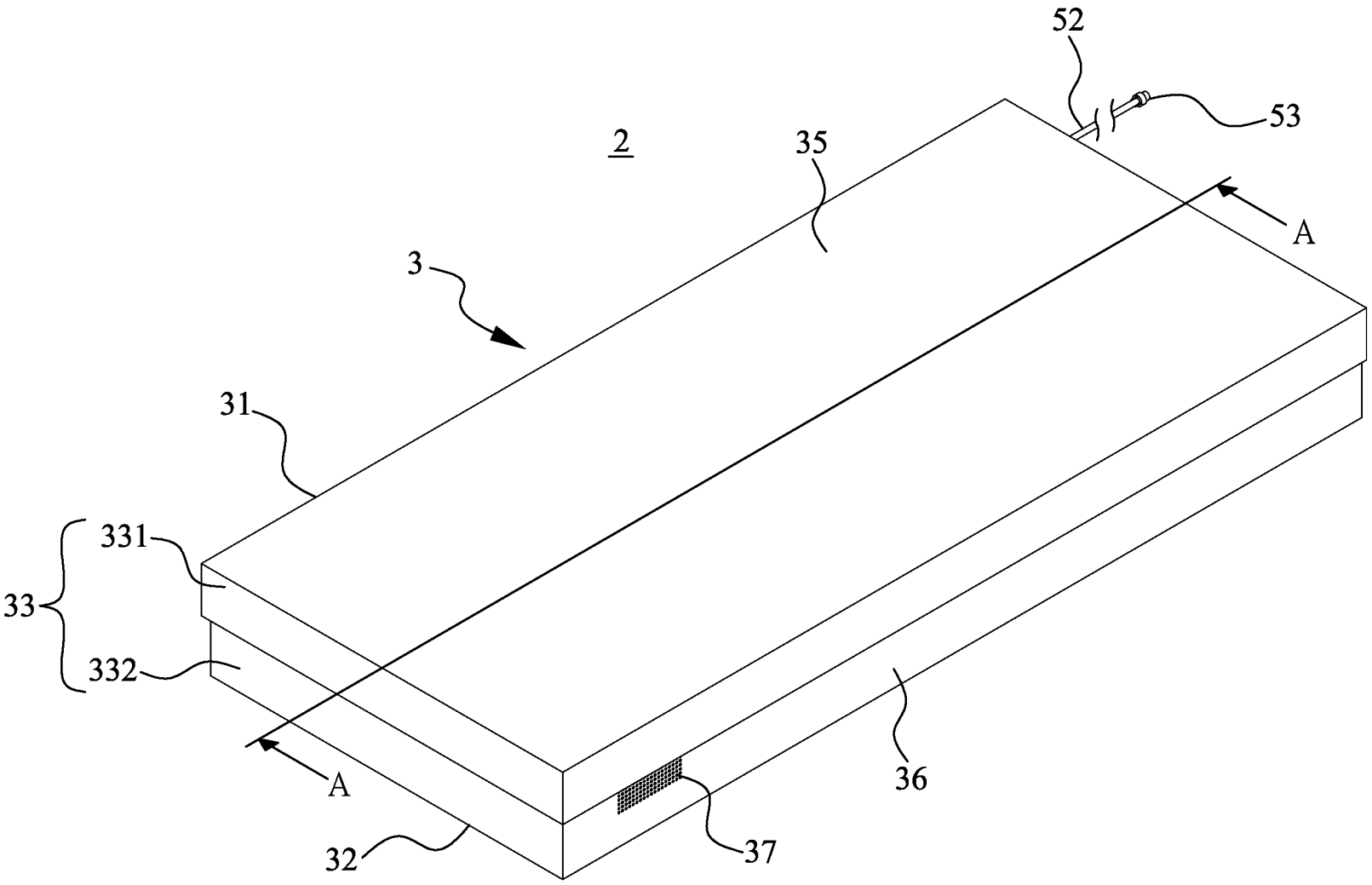
FIG. 2 is an assembled perspective view of an inflatable air mattress device according to a preferred embodiment of the present invention.
Figure 3:
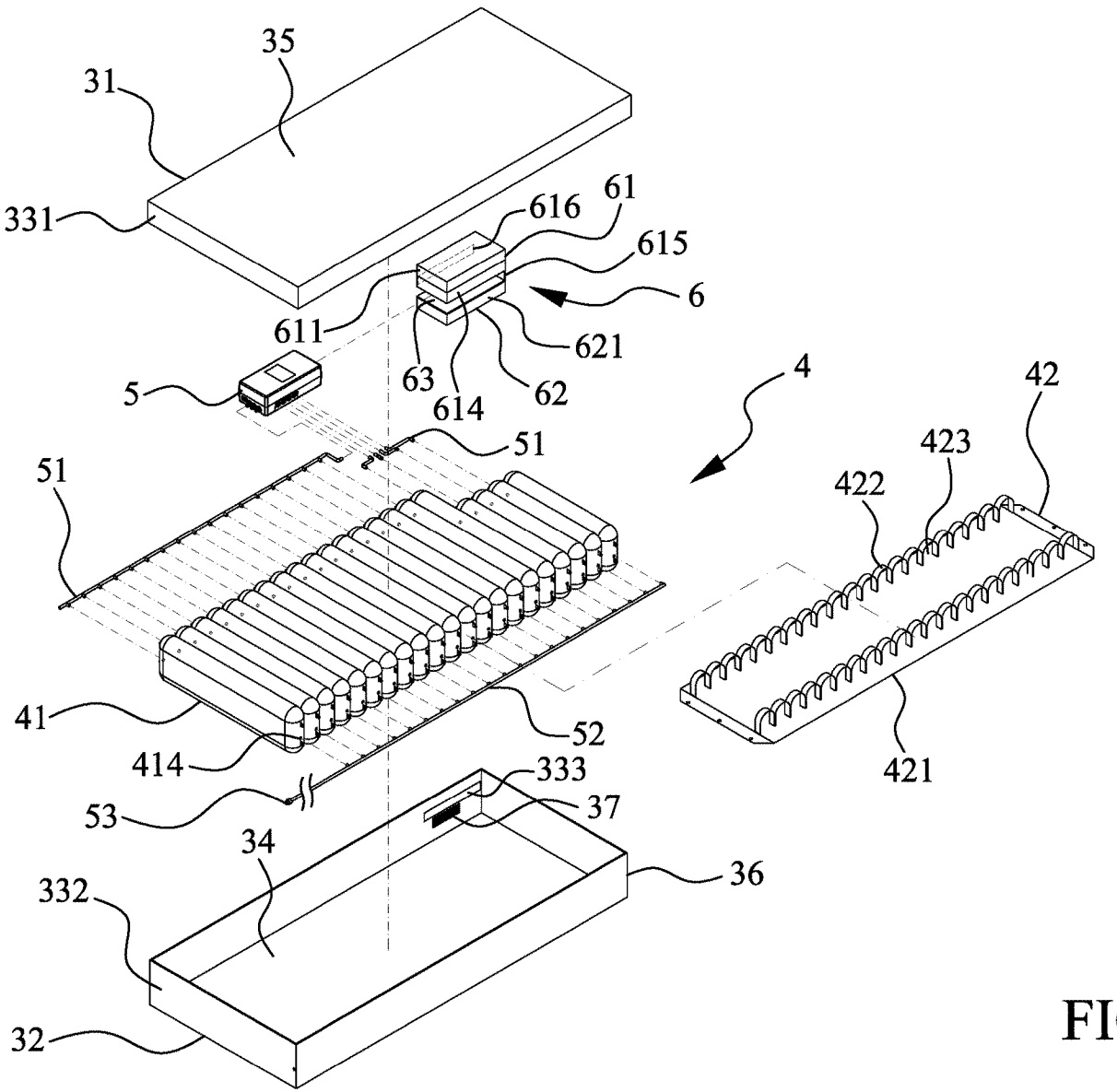
FIG. 3 is an exploded view of the inflatable air mattress device of FIG. 2.

Please refer to FIGS. 2 and 3, which are assembled and exploded perspective views, respectively, showing an inflatable air mattress device 2 according to a preferred embodiment of the present invention includes a cover 3, an air mattress 4 and a pump 5. The cover 3 consists of a top portion 31, a bottom portion 32 and a wall portion 33. The wall portion 33 is located between the top portion 31 and the bottom portion 32, such that the wall portion 33 together with the top portion 31 and the bottom portion define a receiving space 34 in between them.

In the illustrated preferred embodiment, the wall portion includes an outer part 331 and an inner part 332. The top portion 31 and the outer part 331 of the wall portion 33 together define an upper cover 35, while the bottom portion 32 and the inner part 332 of the wall portion 33 together define a lower cover 36, which has dimensions slightly smaller than those of the upper cover 35. Therefore, the upper cover 35 can be vertically moved relative to the lower cover 36 to a position away from the lower cover 36, so that the cover 3 is in an opened state; or to a position adjoining the lower cover 36, so that the cover 3 is in a closed state. When the cover 3 is in the opened state, the air mattress 4 and the pump 5 can be installed in the receiving space 34 inside the cover 3.

As can be seen from FIGS. 2 and 3, the inner part 332 of the wall portion 33 is provided at a section adjacent to the pump 5 with a plurality of heat-dissipation holes 37, so that heat produced by the pump 5 during the operation thereof can pass through the heat-dissipation holes 37 to dissipate into an environment outside the cover 3. Further, the outer part 331 of the wall portion 33 has a vertical height smaller than that of the inner part 332. Therefore, when the cover 3 is in the closed state with the upper cover 35 being covered onto the lower cover 36, the outer part 331 only overlaps the inner part 332 without blocking the heat-dissipation holes 37.

Figure 4:
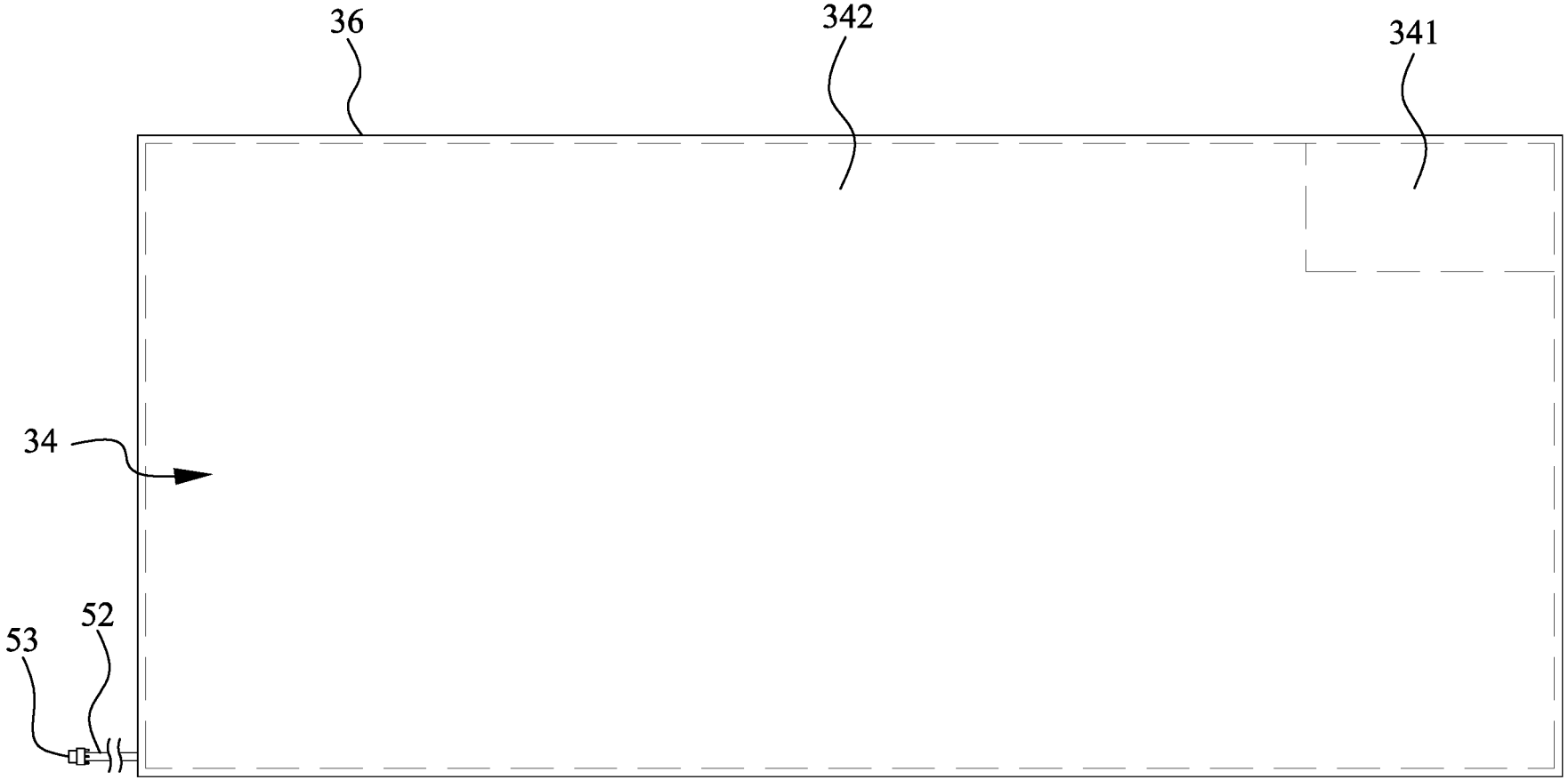
FIG. 4 is a top view showing a first example of arrangement of zones in the inflatable air mattress device of the present invention for an air mattress and a pump thereof.
Figure 5:
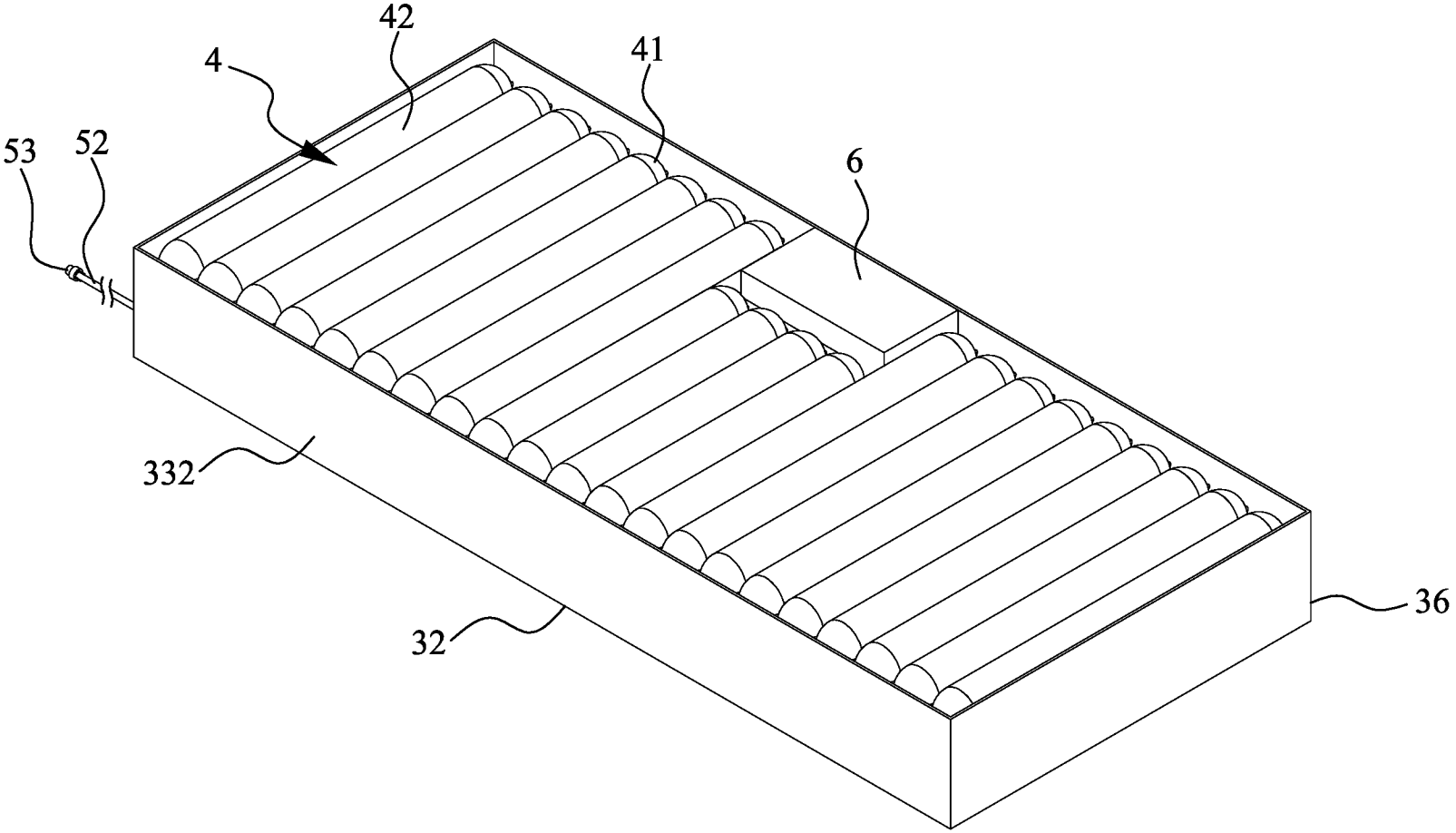
FIG. 5 shows another example of arrangement of zones in the inflatable air mattress device of the present invention for the air mattress and the pump.

FIG. 4 is a top view of the lower cover 36 showing a small part of the receiving space 34 forms a first receiving zone 341, in which the pump 5 is installed; and the rest part of the receiving space 34 forms a second receiving zone 342, in which the air mattress 4 is installed. The first receiving zone 341 is so located that it adjoins at least one wall surface of the wall portion 33. For example, as shown in FIG. 4, the first receiving zone 341 for installing the pump 5 is located at a corner of the receiving space 34 and therefore adjoins two adjacent wall surfaces of the wall portion 33. It is understood the location of the first receiving zone 341 shown in FIG. 4 is only illustrative. In other examples, the first receiving zone 341 for installing the pump 5 can be arranged to adjoin one single longer wall surface of the wall portion 33, as shown in FIG. 5, or to adjoin one single shorter wall surface of the wall portion 33 (not shown).

Figure 6:
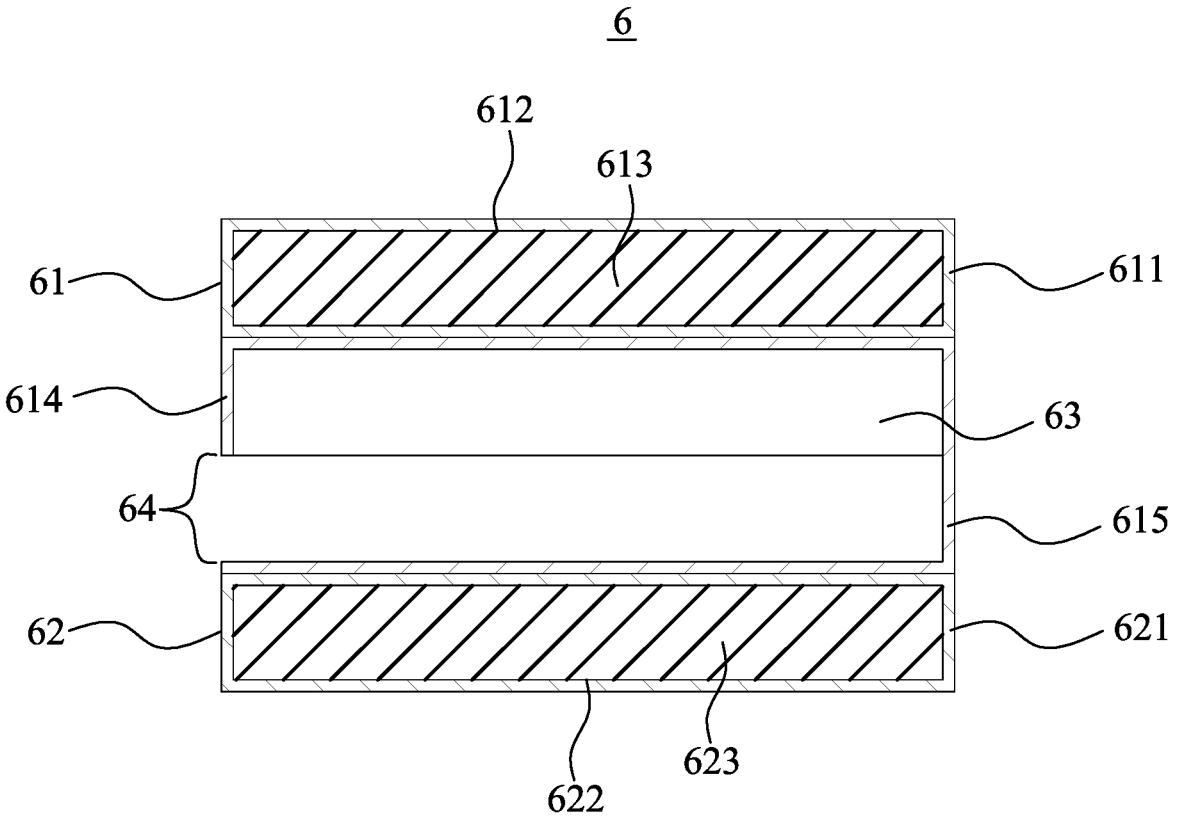
FIG. 6 is a sectional side view of a movement-limiting mechanism provided in a lower cover of the inflatable air mattress device of the present invention.
Figure 7:
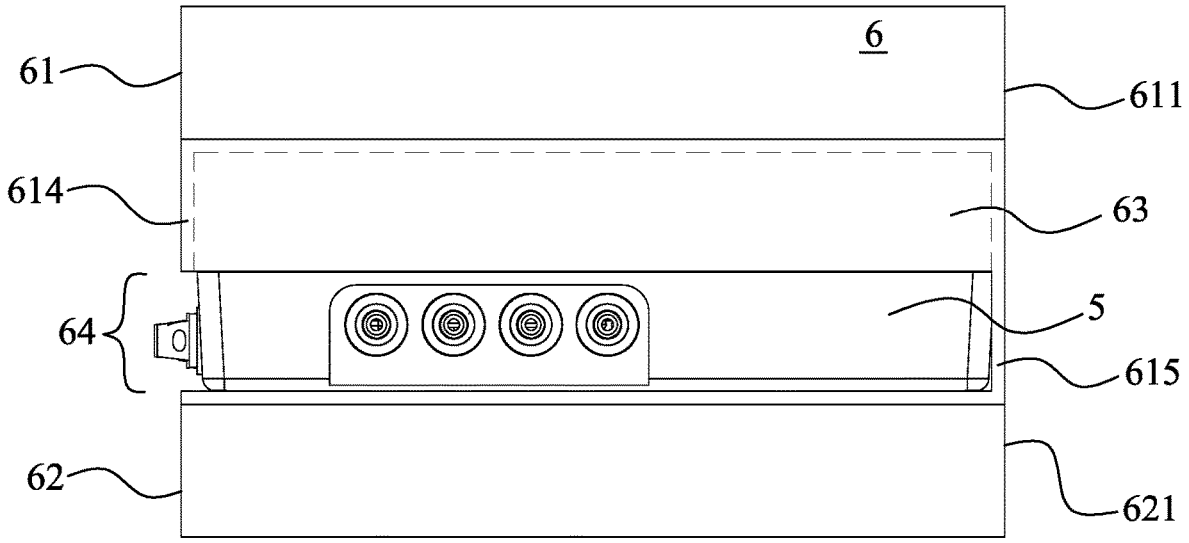
FIG. 7 shows the movement-limiting mechanism of FIG. 6 in a closed state to confine the pump therein.
Figure 8:
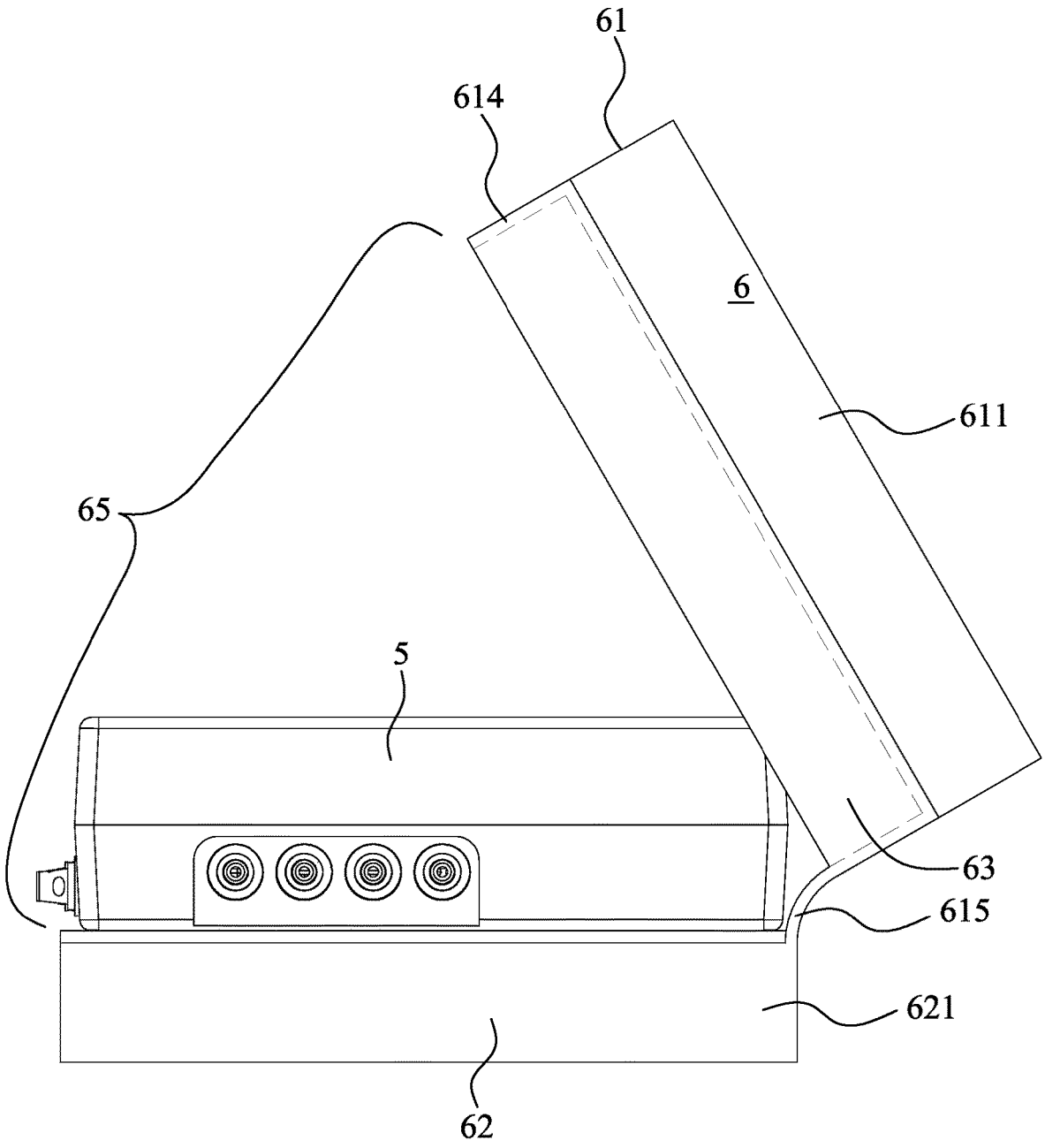
FIG. 8 shows the movement-limiting mechanism of FIG. 6 in an opened state to allow removal of the pump therefrom.

Please refer to FIGS. 6 to 8. A movement-limiting mechanism 6 is set in the first receiving zone 341 to hold the pump 5 therein in a shock-absorbing manner. The movement-limiting mechanism 6 includes a cap portion 61 and a seat portion 62, which are so arranged that a vertical space is formed between them. The cap portion 61 includes a first receiving section 611, which internally defines a first space 612 for receiving a piece of elastic material 613 therein; a stop section 614 forming a wall extended around a lower peripheral edge of the first receiving section 611; and a connecting section 615 downward extended from a part of the stop section 614 to connect to the seat portion 62. The seat portion 62 includes a second receiving section 621, which internally defines a second space 622 for receiving another piece of elastic material 623 therein. The elastic material 613 in the first receiving section 611 and the elastic material 623 in the second receiving section 621 together provide a shock-absorbing effect to protect the pump 5 held in the movement-limiting mechanism 6 against external shock or vibration and to prevent a user of the inflatable air mattress device 2 from feeling uncomfortable due to being in direct contact with a rigid case of the pump 5.

The first receiving section 611 and the stop section 614 of the cap portion 61 together with the second receiving section 621 of the seat portion 62 define a movement-limiting space 63 in between them. The pump 5 is set in the movement-limiting space 63 and restricted from moving therein. The cap portion 61 is vertically pivotally turnable relative to the seat portion 62 via the connecting section 615. When the cap portion 61 is pivotally turned to a position immediately above the seat portion 62, as shown in FIGS. 6 and 7, a line-connecting passage 64, which has a size smaller than a sectional height of the pump 5, is formed between the stop section 614 of the cap portion 61 and the second receiving section 621 of the seat portion 62, allowing the air mattress 4 (not shown in FIGS. 6 and 7) to be fluidly connectable to the pump 5 via the line-connecting passage 64. On the other hand, when the cap portion 61 is pivotally turned to a position away from the seat portion 62 as shown in FIG. 8, a pump-removal passage 65, which has a size larger than the sectional height of the pump 5, is formed between the stop section 614 of the cap portion 61 and the second receiving section 621 of the seat portion 62, allowing the pump 5 to be conveniently removed from the movement-limiting space 63.

As can be seen in FIG. 3, a male connecting element 616 is provided on the first receiving section 611 of the cap portion 61, and a female connecting element 333 is correspondingly provided on the wall portion 33 at a location adjacent to the movement-limiting mechanism 6. Through engagement of the male connecting element 616 with the female connecting element 333, the cap portion 61 is held in place to the cover 3, keeping the cap portion 61 and the seat portion 62 in a state of spacing from each other.

Referring to FIGS. 3 and 4. The air mattress 4 is installed in the second receiving zone 342 of the receiving space 34 and consists of a plurality of transverse air cells 41 parallelly arranged side by side. The air cells 41 are held to one another via a locating device 42. Some of the air cells 41 have a first width, while other air cells 41 have a second width. A sum of the second width of the air cells and a width of the pump 5 is equal to the first width.

Figure 9:
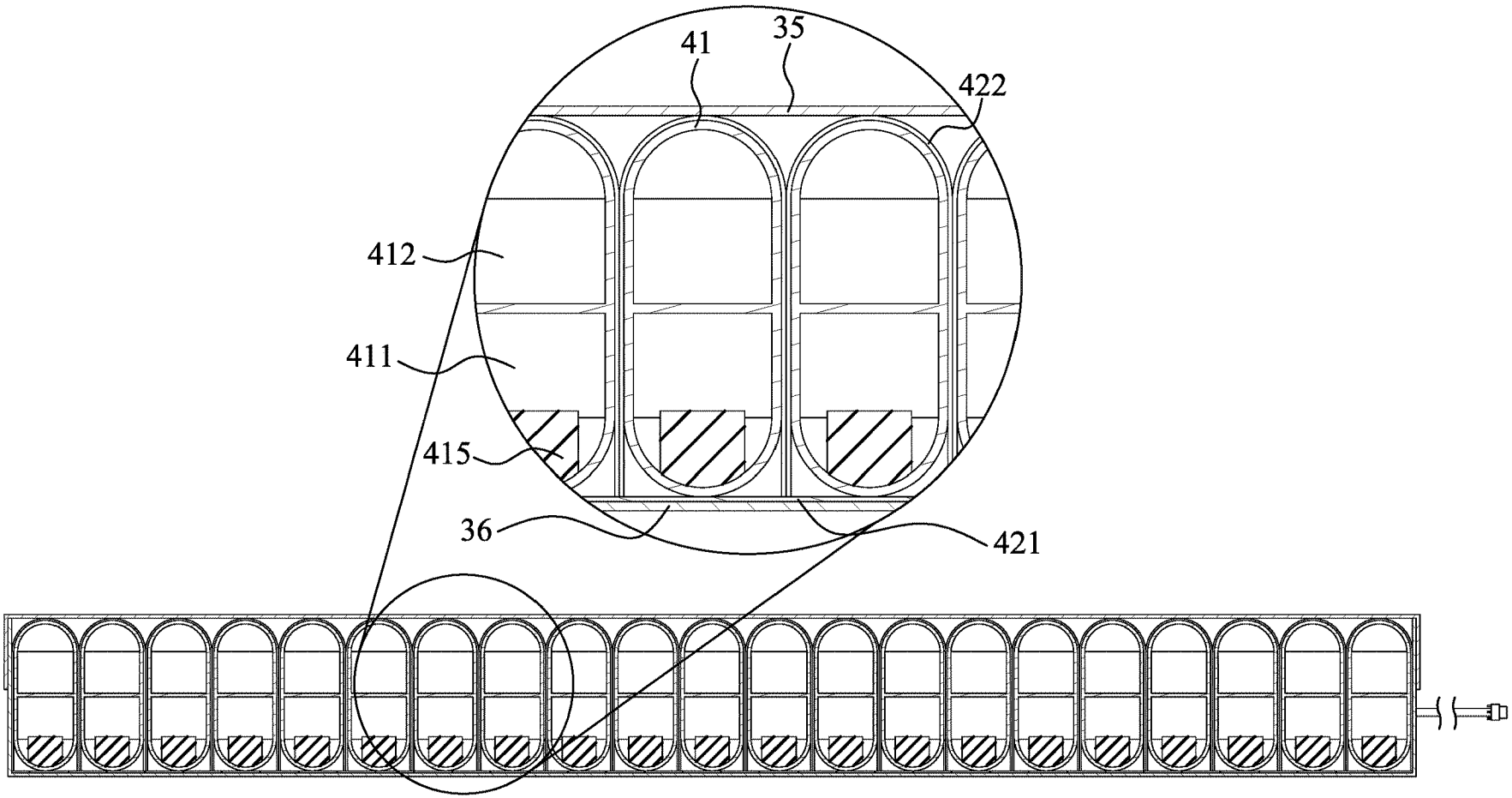
FIG. 9 is a sectional view taken along line A-A of FIG. 2.
Figure 10:
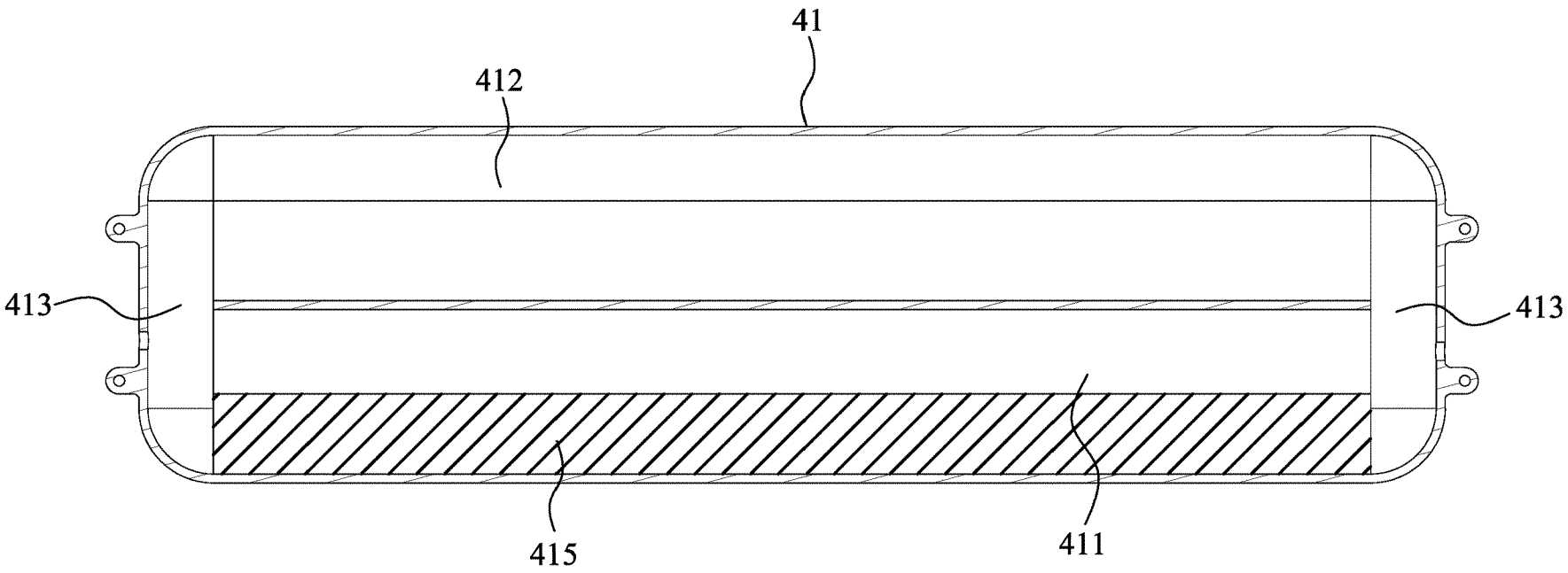
FIG. 10 is a sectional side view of a first embodiment of an air cell for the inflatable air mattress device of the present invention.

Please refer to FIG. 9 that is a sectional view taken along line A-A of FIG. 2 with a circled area of FIG. 9 being enlarged, and to FIG. 10 that is a sectional side view showing a first embodiment of the air cell 41. The air cell 4 illustrated in FIG. 10 includes a first air chamber 411, a second air chamber 412 located immediately above the first air chamber 411, and at least one communicating hole 413 communicating with the first and the second air chamber 411, 412. The first air chamber 411 is provided with a plurality of air valves 414 (see FIG. 3) and is internally provided with an elastic member 415. When the air cell 41 is in an inflated state for normal use, air in the first air chamber 411 and the second air chamber 412 together supports the weight of the user's body.

Figure 11:
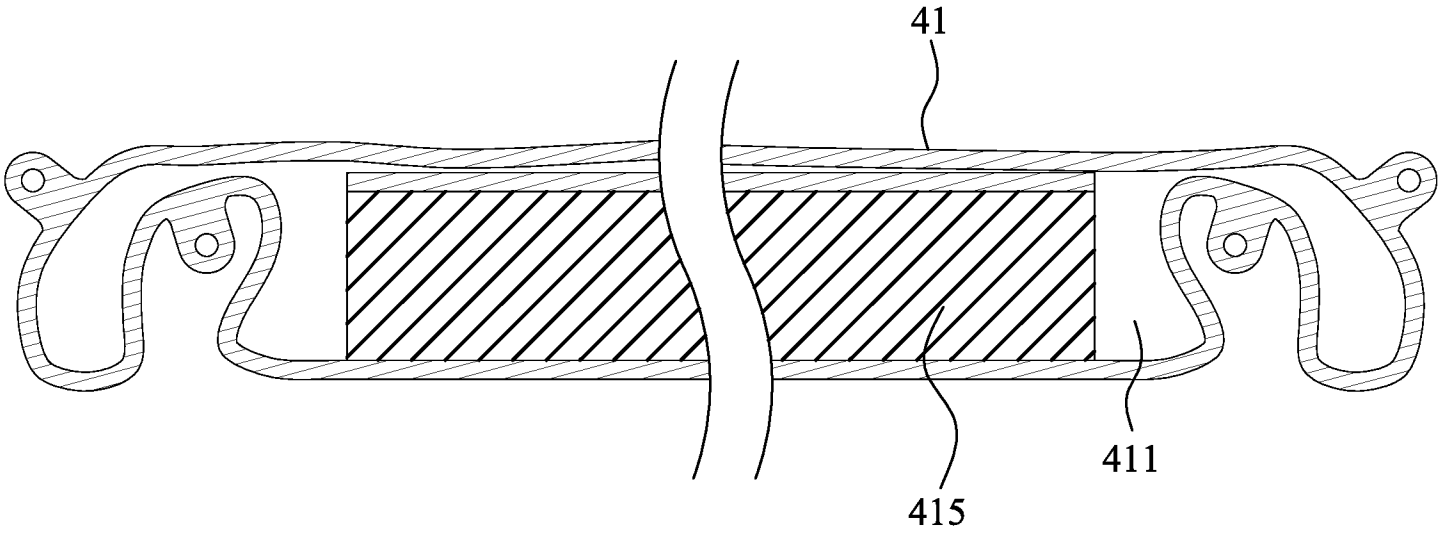
FIG. 11 shows the air cell of FIG. 10 in a deflated state.

As shown in FIG. 11, when the air cell 41 is in an abnormal leaked state, the elastic member 415 in the first air chamber 411 serves to support the weight of the user's body.

Please refer to FIG. 3 again. The locating device 42 includes a bottom board 421 and a plurality of locating elements 422. The locating elements 422 are connected to the bottom board 421 and are sequentially arranged along two opposite longitudinal sides of the bottom board 421 in pairs, such that each of the locating elements 422 internally defines a fitting passage 423 for receiving an end of one air cell 41 therein. That is, each of the air cells 41 is held to the bottom board 421 with two ends of the air cell 41 extended through a pair of two laterally aligned fitting passages 423 defined by two corresponding locating elements 422 on the bottom board 421.

Figure 12:
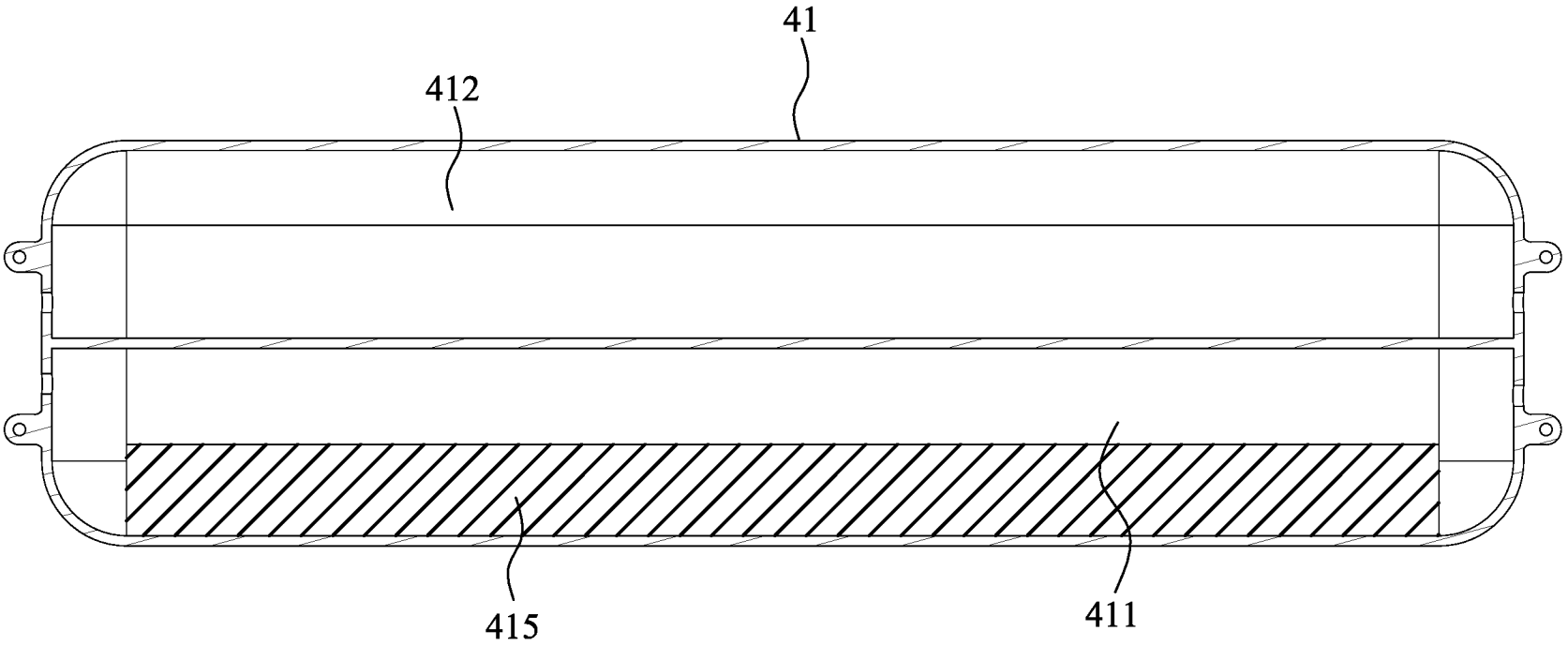
FIG. 12 is a sectional side view of a second embodiment of the air cell for the inflatable air mattress device of the present invention.

Please refer to FIG. 12. In a second embodiment of the air cell 41, the first air chamber 411 and the second air chamber 412 are two independent chambers. In this embodiment, the first air chamber 411 and the second air chamber 412 respectively have an air valve 414 (not shown in FIG. 12) provided thereon for connecting to the pump 5.

Figure 13:
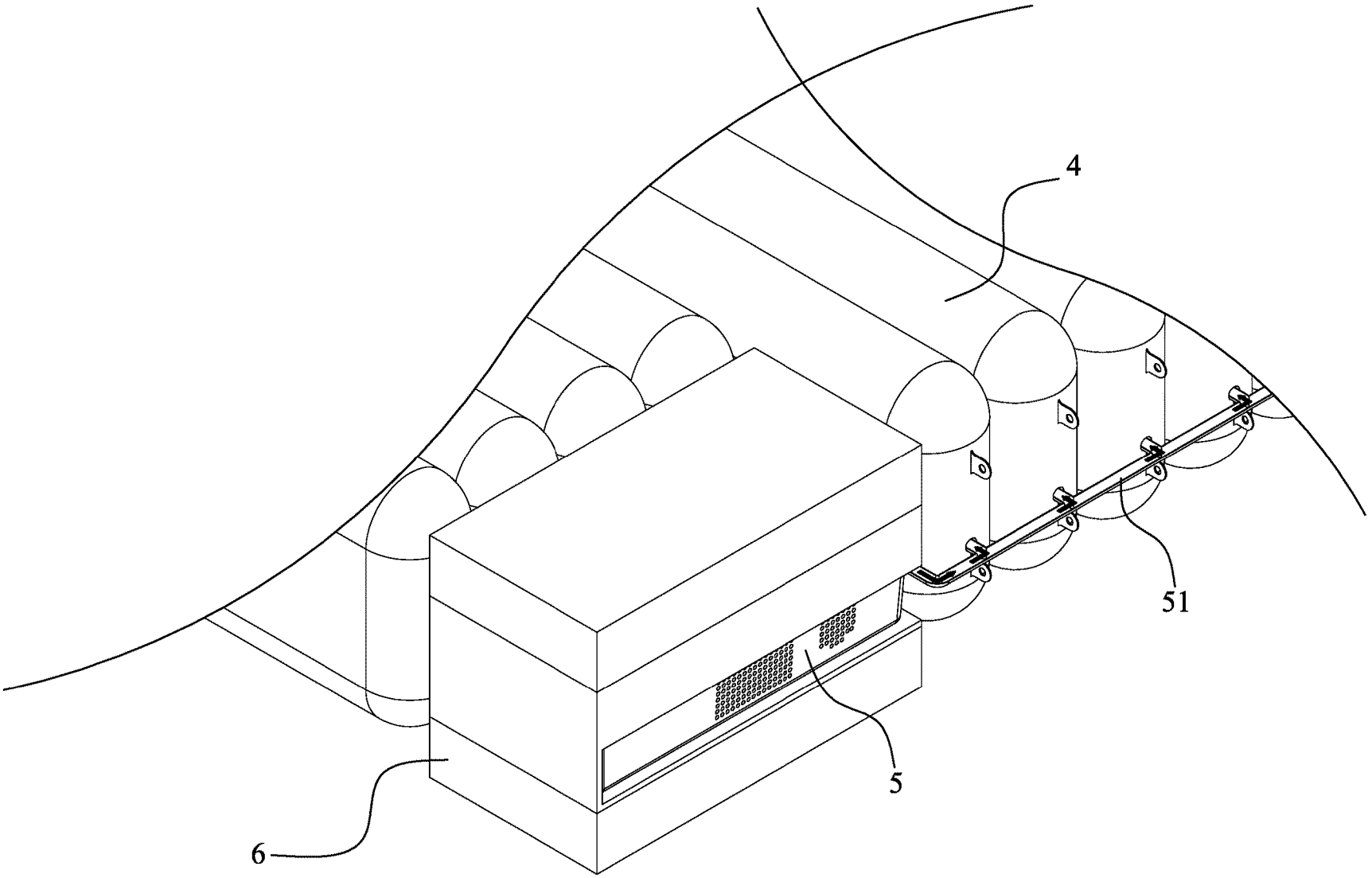
FIG. 13 indicates the direction of airflow when the pump inflates the air cells of the inflatable air mattress device of the present invention.
Figure 14:
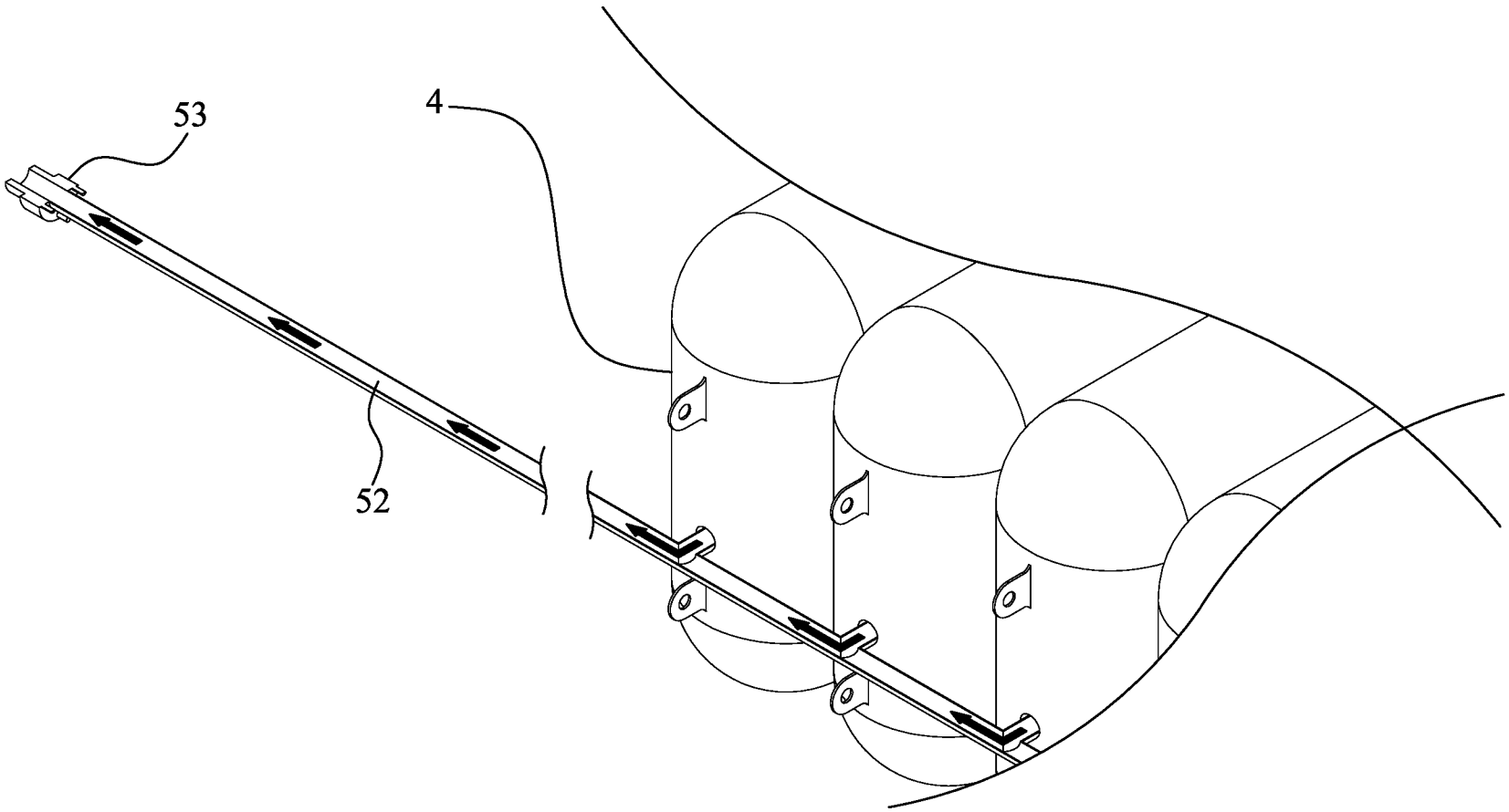
FIG. 14 indicates the direction of airflow when the air cells of the inflatable air mattress device of the present invention are deflated and air is released via an air release valve.

Referring to FIGS. 3, 13 and 14 at the same time. The pump 5 is installed in the first receiving zone 341 of the receiving space 34 and is held in place via the movement-limiting mechanism 6. The pump 5 is provided with an air input line 51 communicably connected to each of the air cells 41 of the air mattress 4 for supplying air into the air cells 41 to change a volume of each of the air cells, and an air release line 52 with all the air cells 41 connected thereto. The air release line 52 has an air release valve 53 mounted thereon for controlling the air release line 52 to an open state or a closed state.

As shown in FIG. 3, two sides of the pump 5 adjoining the air cells 41 are respectively provided with a plurality of air delivery holes. The air delivery holes formed on one of the two sides of the pump 5 are connected to the air cells 41 with the second width, while the air delivery holes formed on the other side of the pump 5 are connected to the air cells 41 with the first width. The air cells 41 are respectively connected at one end, which are located on one longitudinal side of the air mattress 4, to the air input line 51, and at another ends, which are located on the other longitudinal side of the air mattress 4, to the air release line 52.

Figure 15:
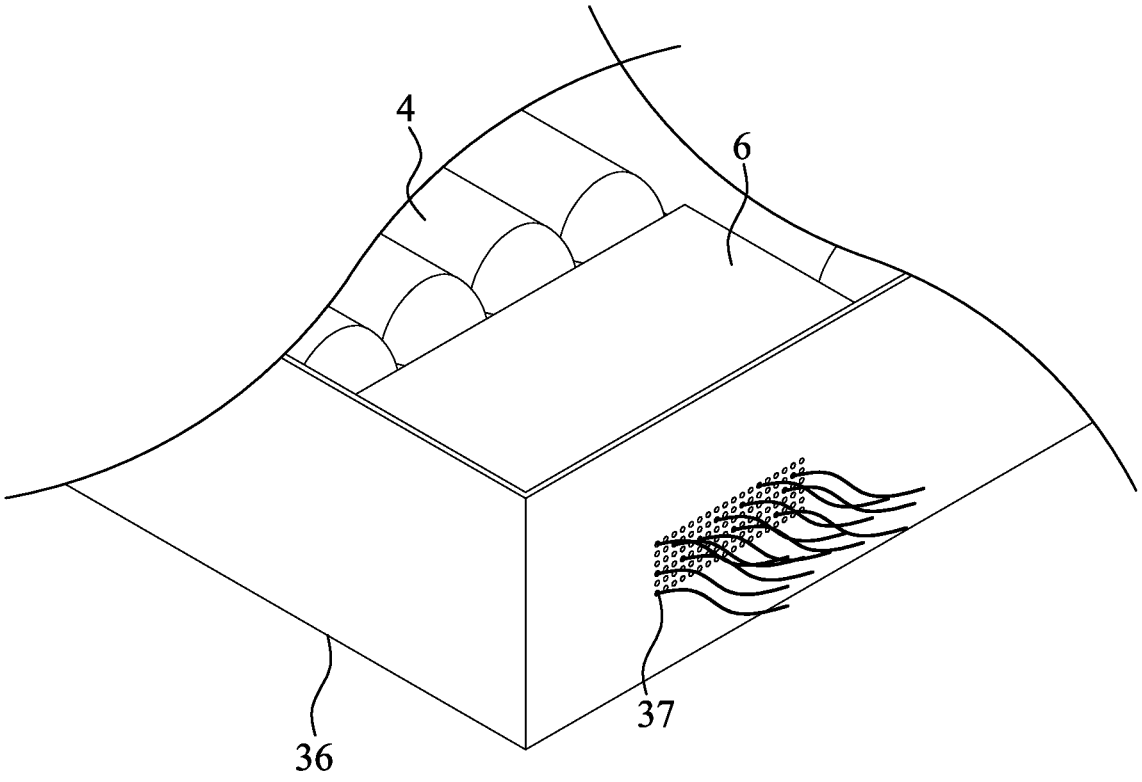
FIG. 15 shows heat produced by the pump is dissipated into an environment outside the lower cover of the inflatable air mattress device of the present invention.

Referring to FIG. 15. The pump 5 includes a cooling fan, which is arranged in the pump 5 at a position adjacent to the heat-dissipation holes 37 on the lower cover 36 of the cover 3. Heat produced by the pump 5 during the operation thereof is forced out of the cover 3 via the cooling fan, lest the pump 5 installed and operated inside the cover 3 should be overheated.

The present invention has been described with some preferred embodiments thereof and it is understood that many changes and modifications in the described embodiments can be carried out without departing from the scope and the spirit of the invention that is intended to be limited only by the appended claims.

What is claimed is:

1. An inflatable air mattress device, comprising:

a cover including a top portion, a bottom portion and a wall portion, the wall portion having four wall surfaces located between the top portion and the bottom portion, such that the top portion, the bottom portion and the wall portion together define a receiving space therebetween, a part of the receiving space forming a first receiving zone and the rest of the receiving space forming a second receiving zone, the first receiving zone and the second receiving zone being arranged in a first direction parallel to a surface of the bottom portion of the cover, and having the same height, the first receiving zone adjoining at least one of the four wall surfaces of the wall portion and having a movement-limiting mechanism set therein;

an air mattress installed in the second receiving zone of the receiving space, and including a plurality of transverse air cells that are parallelly arranged side by side in the first direction, each of the air cells including a first air chamber, and a second air chamber disposed directly on the first air chamber in a second direction orthogonal to the surface of the bottom portion, the first air chamber of each of the air cells including an elastic member therein, each of the first air chamber and the second air chamber supporting a weight of a user's body when the air cells are used in a normal state, the elastic member of the first air chamber of each of the air cells supporting the weight of the user's body when the air cells are used in an abnormal leaked state; and a pump installed in the first receiving zone of the receiving space, and held in the movement-limiting mechanism the pump being provided with an air input line communicably connected to each of the air cells of the air mattress for supplying air into the air cells to change a volume of each of the air cells.

2. The inflatable air mattress device as claimed in claim 1, further comprising a locating device, wherein the locating device is set in the second receiving zone of the receiving space and includes a bottom board and a plurality of locating elements sequentially connected in pairs to two opposite longitudinal sides of the bottom board, and each of the pairs of the locating elements are aligned in a third direction orthogonal to the first direction on the surface of the bottom portion, and define a fitting passage for receiving a corresponding one of the air cells therein, such that each of the air cells is held by a corresponding one of pairs of the locating elements on the bottom board.

3. The inflatable air mattress device as claimed in claim 1, wherein the movement-limiting mechanism includes a seat portion, a cap portion pivotally movable relative to the seat portion to change a relative position between the cap portion and the seat portion, the seat portion and the cap portion together defining a movement-limiting space therebetween for holding the pump therein;

a line-connecting passage having a size smaller than a sectional height of the pump being formed between the cap portion and the seat portion when the cap portion is moved to a position immediately above the seat portion; and a pump-removal passage having a size larger than the sectional height of the pump being formed between the cap portion and the seat portion when the cap portion is moved to a position away from the seat portion.

4. The inflatable air mattress device as claimed in claim 3, wherein the cap portion includes a first receiving section internally defining a first space and a stop section extended around a lower peripheral edge of the first receiving section, and wherein the seat portion includes a second receiving section internally defining a second space.

5. The inflatable air mattress device as claimed in claim 4, wherein the first space and the second space respectively have a piece of elastic material received therein.

6. The inflatable air mattress device as claimed in claim 4, wherein the first receiving section of the cap portion is provided with a male connecting element and the wall portion of the cover is provided with a female connecting element at a location corresponding to the male connecting element.

7. The inflatable air mattress device as claimed in claim 1, wherein each of one or more of the air cells has a first width while each of the rest of the air cells has a second width, a sum of the second width of the air cells and a width of the pump being equal to a sum of the first width of the air cells.

8. The inflatable air mattress device as claimed in claim 1, wherein all the air cells are connected to an air release line, and the air release line having an air release valve mounted thereon for controlling of a state of the air release line between an open state and a closed state.

9. The inflatable air mattress device as claimed in claim 1, wherein the wall portion includes an outer part, and an inner part that is positioned an inner side of the outer part, and the top portion of the cover and the outer part of the wall portion of the cover together define an upper cover, and the bottom portion of the cover and the inner part of the wall portion of the cover together define a lower cover, the upper cover being removable from the lower cover.

10. The inflatable air mattress device as claimed in claim 9, wherein the inner part of the wall portion is provided at a section adjacent to the pump with a plurality of heat-dissipation holes, and wherein the outer part of the wall portion has a height in the second direction smaller than that of the inner part of the wall portion.

* * * * *